US006955561B2

(12) United States Patent
Seymour et al.

(10) Patent No.: US 6,955,561 B2
(45) Date of Patent: Oct. 18, 2005

(54) INLINE CONNECTOR

(75) Inventors: Douglas G. Seymour, York, PA (US); Randall E. Gillotti, Warren, PA (US); Michael J. Swantner, Warren, PA (US)

(73) Assignee: OSRAM Sylvania Inc., Danvers, MA (US)

( * ) Notice: Subject to any disclaimer, the term of this patent is extended or adjusted under 35 U.S.C. 154(b) by 0 days.

(21) Appl. No.: 10/783,443

(22) Filed: Feb. 20, 2004

(65) Prior Publication Data

US 2004/0198094 A1 Oct. 7, 2004

Related U.S. Application Data

(60) Provisional application No. 60/450,001, filed on Feb. 26, 2003.

(51) Int. Cl.[7] ..... H01R 9/05
(52) U.S. Cl. ..... 439/578; 439/585
(58) Field of Search ..... 439/578–585

(56) References Cited

U.S. PATENT DOCUMENTS 4,688,876 A * 8/1987 Morelli ..... 439/578
4,746,305 A * 5/1988 Nomura ..... 439/319
4,954,669 A * 9/1990 Banning et al. ..... 174/75 C
5,066,248 A * 11/1991 Gaver et al. ..... 439/578
5,967,852 A 10/1999 Follingstad et al. ..... 439/675
6,109,963 A * 8/2000 Follingstad et al. ..... 439/578
6,159,046 A * 12/2000 Wong ..... 439/578
6,530,808 B1 * 3/2003 Hosler et al. ..... 439/585
2003/0224657 A1 * 12/2003 Malloy ..... 439/578

* cited by examiner

*Primary Examiner*—Michael C. Zarroli
(74) *Attorney, Agent, or Firm*—Kenneth D. Labudda

(57) ABSTRACT

An in-line coaxial cable connector (10) has an electrically insulating member (32) that is fitted over a first electrical contact (22) and has a first end (32*a*) and a second end (46) extending over a second end (26) of the first electrical contact (22). The terminus of the second end (46) includes a lip (48) forming an alignment area for the reception of a mating electrical contact. The lip (48) protects the contact beams of the contact (22) and eliminates the possibility of the contact (22) mismating with its complement on a mating connector.

4 Claims, 2 Drawing Sheets

INLINE CONNECTOR

CROSS-REFERENCE TO RELATED APPLICATIONS

This application claims priority from Provisional Patent Application No. 60/450,001, filed Feb. 26, 2003.

TECHNICAL FIELD

This invention relates to electrical connectors and more particularly to terminal connectors for coaxial cable.

BACKGROUND ART

Previous terminal connectors for coaxial cable included a metal sleeve that was crimped around the outer insulation of the cable which then had a section of the braided ground connection folded back over the metal sleeve. A male/female contact was soldered to the center conductor An insulator was then slid over the contact, expanding to allow a contact retention feature to pass and then returning to its original shape to retain the contact. This subassembly was subsequently inserted into a metal shell, which was then hex-crimped to secure the complete assembly.

This connector utilized a stamped contact, which was soldered to the center conductor of the cable. The inherent variability of the solder process created both mechanical and electrical issues. The coaxial cable braid was folded back over the crimp sleeve, which allowed for the possibility of long strands, which could reach the center contact and cause a short circuit. The contact was retained by the insulator expanding to allow a first ball shape to enter the insulator. The insulator then returned to its original shape. The limited length of contact/insulator interface did not provide adequate centering for the contact. Further, the insulator provided no protection for the contact beams, which could sustain damage due to stubbing with the mating connector.

DISCLOSURE OF INVENTION

It is, therefore, an object of the invention to obviate the disadvantages of the prior art.

It is another object of the invention to enhance coaxial cable connectors.

These objects are accomplished, in one aspect of the invention, by the provision of an in-line coaxial cable conductor that comprises a coaxial cable having a central conductor with a first section thereof exposed; an inner insulation with a second section exposed; a braided electrical conductor having a third section exposed, and an outer insulation beginning at the terminus of the third section.

A first electrical contact has a first end affixed to the first section of exposed central conductor and has a hollow second end formed to engage a mating electrical contact.

An electrically conductive eyelet is fitted between the inner insulation and the braided electrical conductor at the exposed third section.

An electrically conductive sleeve overlies the third section and at least a portion of the outer insulation and is fixed thereto.

An electrically insulating member is fitted over the first electrical contact and has a first end extending at least partway over the second section and a second end extending over the second end of the electrical contact. The terminus of the second end includes a lip that forms an alignment area for the reception of the mating electrical contact. An electrically conductive metal shell is positioned over the insulating member and extends forward of the second end of the contact and rearward of the sleeve.

The use of the metal eyelet under the braid eliminates long strands of braid wire that could reach the center conductor and cause a short circuit and the lip formed on the terminus of the insulator provides protection for the contact beams during mating.

BEST MODE FOR CARRYING OUT THE INVENTION

For a better understanding of the present invention, together with other and further objects, advantages and capabilities thereof, reference is made to the following disclosure and appended claims in conjunction with the above-described drawings.

Figure 1:
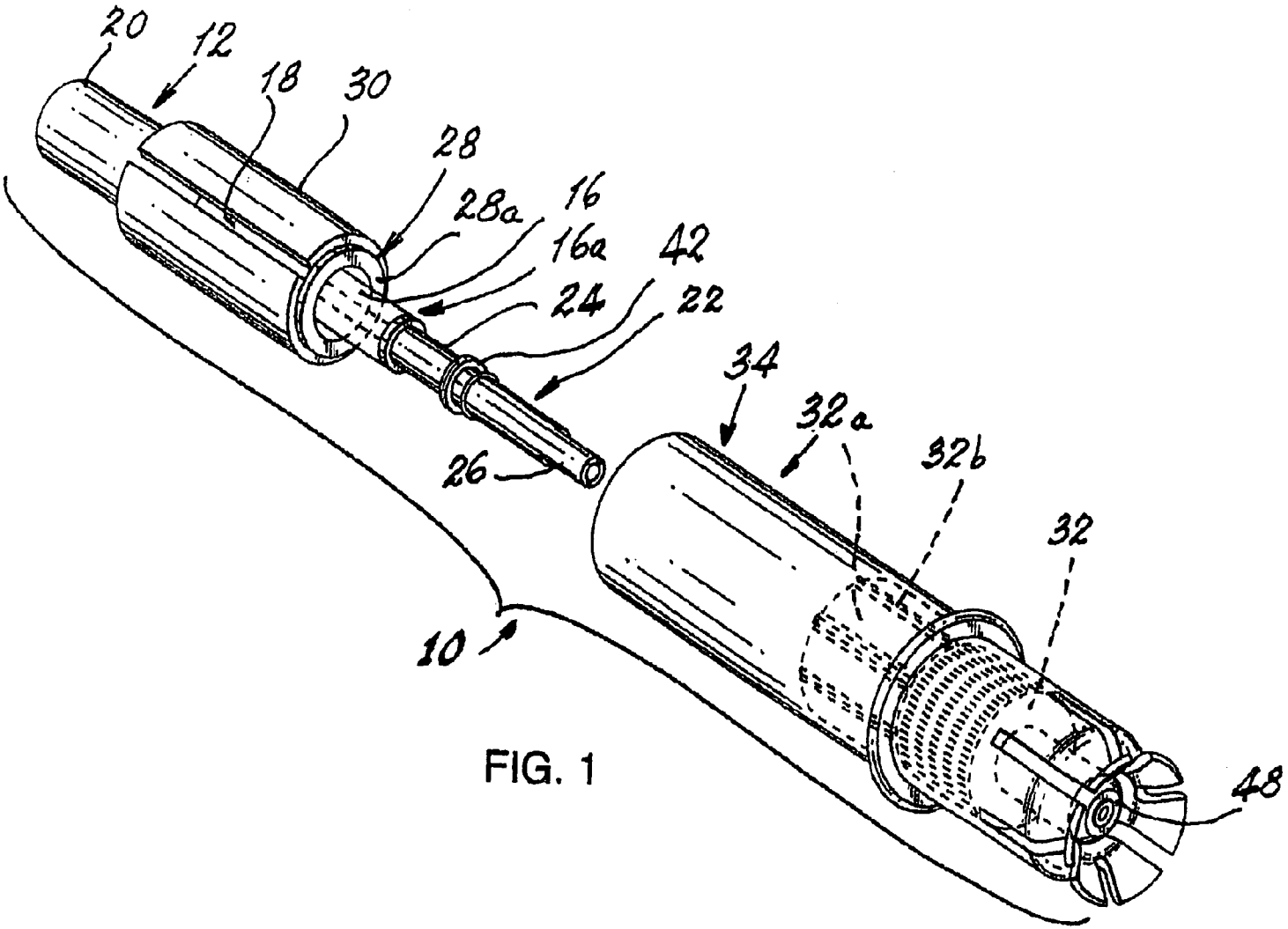
FIG. 1 is an exploded perspective view of an embodiment of the invention.
Figure 2:
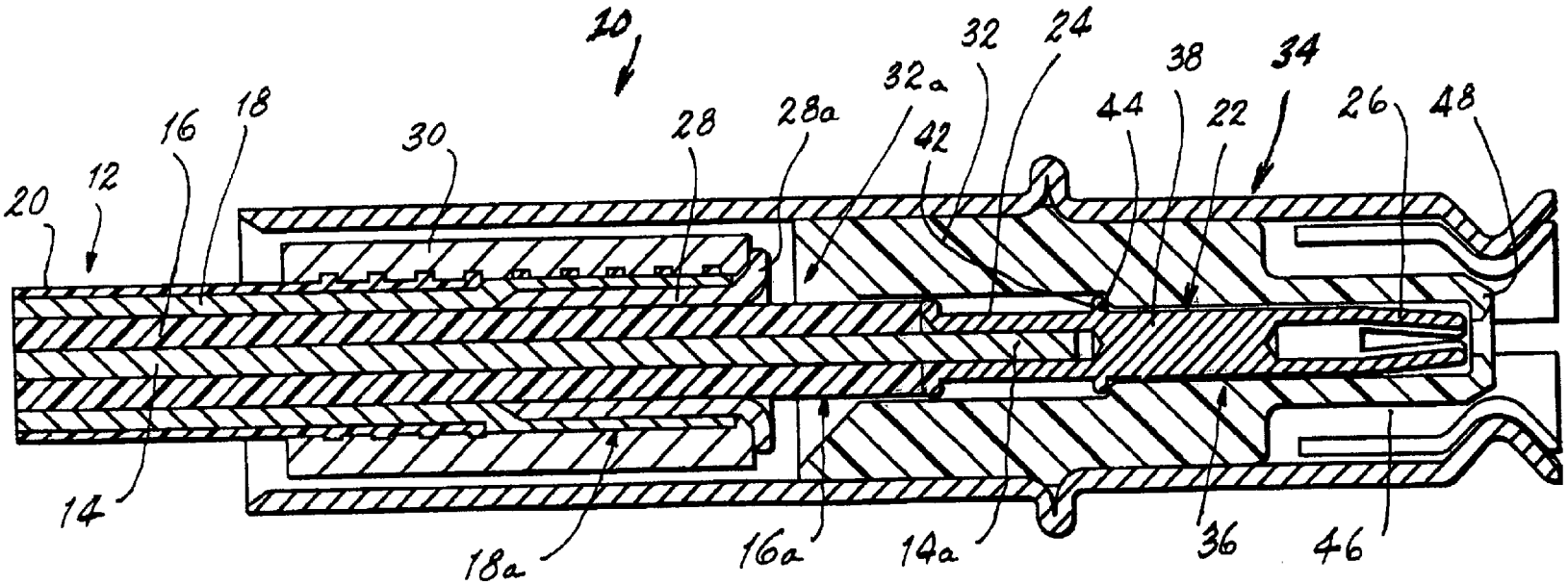
FIG. 2 is an elevational sectional of an embodiment of the invention.

Referring now to the drawings with greater particularity, there is shown in FIG. 2 an in-line coaxial cable connector 10 comprising a coaxial cable 12 having a central conductor 14 with a first section 14*a* exposed, an inner insulation 16 with a second section 16*a* exposed; a braided electrical conductor 18 having a third section 18*a* exposed, and an outer insulation 20 beginning at the terminus of the third section 18*a*. A first electrical contact 22 has a first end 24 affixed to the first section 14*a* of exposed central conductor 14, for example, by crimping, and has a hollow second end 26 with at least two contact beams formed to engage a mating electrical contact, not shown.

An electrically conductive eyelet 28 is fitted between the inner insulation 16 and the braided electrical conductor 18 at the exposed third section 18*a*, thus avoiding the necessity of folding back the braid and creating the potential for loose wires that may cause short circuits. The eyelet 28 includes a flange 28*a* that serves to block any stray braids from shorting to the electrical contact 22.

An electrically conductive sleeve 30 overlies the third section 18*a* and at least a portion of the outer insulation 20 and is fixed thereto, for example, by crimping. The flange 28*a* serves also as a locator for the sleeve 30.

An electrically insulating member 32 is fitted over the first electrical contact and has a first end 32*a* extending at least partway over the second section 16*a* and has a second end 46 extending over the second end 26 of the first electrical contact 22. The terminus of the second end 46 includes a lip 48 forming an alignment area for the reception of the mating electrical contact. The lip 48 protects the contact beams of the contact 22 and eliminates the possibility of the contact 22 mismating with its complement on a mating connector.

An electrically conductive metal shell 34 is positioned over the member 32 and extends forward of the second end

26 of the contact 22 and rearward of the sleeve 30 and is crimped to retain its location. The outer surface of the first end 32*a* of the insulator 32 is provided with a plurality of crush ribs 32*b* which provide the friction fit of the insulator 32 in the metal shell 34.

The first electrical contact 22 is preferably a screw machine part as opposed to a stamped part and has an intermediate portion 36 that is solid and comprises about ⅓ the length of the contact 22 providing exceptional stability for the contact. Additionally the outer surface 38 of the intermediate portion 36 includes a flange 42, the flange 42 operating as a positive stop that engages an interior wall 44 of the insulating member 32.

To properly assemble the connector 10, the coaxial cable 12 is prepared by stripping the appropriate sections 14*a*, 16*a* and 18*a*. The eyelet 28 is fitted between the braid 18 and the inner insulator 16 an the electrically conductive sleeve 30 is fitted thereover and crimped in position. The first electrical contact 22 is then fitted to center conductor 14 at section 14*a* and crimped in place. Electrically insulating member 32 is then pressed into the electrically conductive shell 34 and then the cable end, first electrical contact 22 in place, is inserted into insulating member 32. The cooperation of the flange 42 and the interior wall 44 insures the insertion to the proper depth. After the insertion of the first electrical contact 22 the electrically conductive shell 34 is crimped to the cable 12 to complete the assembly.

While there have been shown and described what are at present considered to be the preferred embodiments of the invention, it will be apparent to those skilled in the art that various changes and modification can be made herein without departing from the scope of the invention as defined by the appended claims.

What is claimed is:

1. An in-line coaxial cable connector comprising:

a coaxial cable having a central conductor with a first section exposed, an inner insulation with a second section exposed; a braided electrical conductor having a third section exposed, and an outer insulation beginning at the terminus of said third section a first electrical contact having a first end affixed to said first section of exposed central conductor and having a hollow second end formed to engage a mating electrical contact;

an electrically conductive eyelet fitted between said inner insulation and said braided electrical conductor at said exposed third section an electrically conductive sleeve overlying said third section and at least a portion of said outer insulation and being fixed thereto;

an electrically insulating member fitted over said first electrical contact and having a first end extending at least partway over said second section, a second end extending over said second end of said first electrical contact, the terminus of said second end of said insulator including a lip forming an alignment area for the reception of said mating electrical contact; and an electrically conductive metal shell positioned over said member and extending forward of said second end of said contact and rearward of said sleeve.

2. The in-line coaxial cable connector of claim 1 wherein said first electrical contact has an intermediate portion that is solid.

3. The in-line coaxial cable connector of claim 2 wherein said intermediate portion of said contact comprises about ⅓ the length of said contact.

4. The in-line coaxial cable connector of claim 3 wherein the outer surface of said intermediate portion includes a flange operating as a positive stop that engages an interior wall of said insulating member.

* * * * *